US007860264B2

(12) United States Patent
Jiles et al.

(10) Patent No.: US 7,860,264 B2
(45) **Date of Patent: *Dec. 28, 2010**

(54) ACOUSTIC ASSEMBLY FOR A TRANSDUCER

(75) Inventors: Mekell Jiles, South Holland, IL (US); David Earl Schafer, Glen Ellyn, IL (US); Anthony D. Minervini, Palos Hills, IL (US); Hanny Sunarto, Bloomingdale, IL (US); Thomas Edward Miller, Arlington Heights, IL (US); Daniel Max Warren, Geneva, IL (US)

(73) Assignee: Knowles Electronics, LLC, Itasca, IL (US)

( * ) Notice: Subject to any disclaimer, the term of this patent is extended or adjusted under 35 U.S.C. 154(b) by 1081 days.

This patent is subject to a terminal disclaimer.

(21) Appl. No.: 11/277,695

(22) Filed: Mar. 28, 2006

(65) Prior Publication Data

US 2006/0215874 A1 Sep. 28, 2006

Related U.S. Application Data

(60) Provisional application No. 60/665,700, filed on Mar. 28, 2005.

(51) Int. Cl.
*H04R 1/00* (2006.01)
*H04R 25/00* (2006.01)

(52) U.S. Cl. ..... 381/423; 381/175; 381/431

(58) Field of Classification Search ..... 381/418, 381/423–425

See application file for complete search history.

(56) References Cited

U.S. PATENT DOCUMENTS 3,502,822 A 3/1970 Sternfeld et al.
3,935,398 A 1/1976 Carlson et al.
4,122,314 A * 10/1978 Matsuda et al. ..... 381/425

(Continued)

FOREIGN PATENT DOCUMENTS

EP 0 851 710 A1 7/1996
EP 851710 A1 * 7/1998

(Continued)

OTHER PUBLICATIONS

International Search Report for Application No. PCT/US06/011599 dated Nov. 20, 2006.

*Primary Examiner*—Brian Ensey
*Assistant Examiner*—Sunita Joshi
(74) *Attorney, Agent, or Firm*—Fitch, Even, Tabin & Flannery

(57) ABSTRACT

An acoustic assembly for use in a transducer includes a multi-layer structure. A first layer member includes a first center portion, a first edge portion and a first aperture separating the first center portion and the first edge portion. A second layer member includes a second center portion, a second edge portion and a second aperture separating the second center portion and the second edge portion such that the second center portion is free to move relative to the second edge portion. The first and second layers are formed into an assembly wherein the first center portion and the second center portion are coupled, the first edge portion and the second edge portion are coupled, and the first aperture and the second aperture are substantially aligned to define a passageway. The assembly has an assembly stiffness that is greater than the stiffness of either the first or second layer members. A hinge joins the assembled first and second center portions and the first and second edge portions such that the assembled first and second center portions is free to at least partially rotate relative to the assembled first and second edge portions about an axis. A flexible layer member is coupled to the assembly and provides airtight sealing of the passageway.

27 Claims, 17 Drawing Sheets

U.S. PATENT DOCUMENTS

| | | | | |
|---|---|---|---|---|
| 4,126,769 | A | 11/1978 | Broersma | |
| 5,524,908 | A | 6/1996 | Reis | |
| 5,633,552 | A * | 5/1997 | Lee et al. | 310/311 |
| 5,757,947 | A | 5/1998 | Van Halteren et al. | |
| RE36,512 | E | 1/2000 | Sone | |
| 6,078,677 | A | 6/2000 | Dolleman et al. | |
| 6,097,829 | A | 8/2000 | Guenther et al. | |
| 6,563,933 | B1 | 5/2003 | Niederdraenk | |
| 6,901,804 | B2 | 6/2005 | Torkkeli | |
| 7,110,565 | B1 * | 9/2006 | Engbert et al. | 381/418 |
| 7,412,763 | B2 | 8/2008 | Jiles et al. | |
| 2001/0012375 | A1 | 8/2001 | Miller et al. | |
| 2002/0136425 | A1 | 9/2002 | Warren | |
| 2002/0146141 | A1 | 10/2002 | Geschiere et al. | |
| 2003/0194102 | A1 | 10/2003 | Yamasaki et al. | |
| 2004/0146176 | A1 * | 7/2004 | Wu | 381/425 |
| 2004/0167377 | A1 * | 8/2004 | Schafer et al. | 600/25 |
| 2005/0111688 | A1 | 5/2005 | Wilmink et al. | |
| 2006/0140436 | A1 | 6/2006 | de Moel et al. | |

FOREIGN PATENT DOCUMENTS

| | | | |
|---|---|---|---|
| EP | 0 969 691 | A1 | 1/2000 |
| GB | 1057853 | | 2/1967 |
| GB | 2 045 028 | | 10/1980 |
| WO | WO 00/60902 | A1 | 10/2000 |

* cited by examiner

ACOUSTIC ASSEMBLY FOR A TRANSDUCER

CROSS-REFERENCE TO RELATED APPLICATIONS

This patent claims benefit under 35 U.S.C. §119(e) to U.S. Provisional Patent Application Ser. No. 60/665,700 filed Mar. 28, 2005, the disclosure of which is hereby expressly incorporated herein by reference.

TECHNICAL FIELD

This patent generally relates to transducers used in listening devices, such as hearing aids or the like, and more particularly, to a composite layered structure for used in the transducers.

BACKGROUND

Hearing aid technology has progressed rapidly in recent years. Technological advancements in this field have improved the reception, wearing-comfort, life-span, and power efficiency of hearing aids. Still, achieving further increases in the performance of ear-worn acoustic devices places ever increasing demands upon improving the inherent performance of the miniature acoustic transducers that are utilized.

There are several different hearing aid styles widely known in the hearing aid industry: Behind-The-Ear (BTE), In-The-Ear or All In-The-Ear (ITE), In-The-Canal (ITC), and Completely-In-The-Canal (CIC). Generally speaking, a listening device, such as a hearing aid or the like, includes a microphone assembly, an amplification assembly and a receiver (speaker) assembly. The microphone assembly receives acoustic sound waves and creates an electronic signal representative of these sound waves. The amplification assembly accepts the electronic signal, modifies the electronic signal, and communicates the modified electronic signal (e.g. processed signal) to the receiver assembly. The receiver assembly, in turn, converts the increased electronic signal into acoustic energy for transmission to a user.

Conventionally, the receiver utilizes moving parts (e.g. armature, acoustic assembly, etc) to generate acoustic energy in the ear canal of the hearing aid wearer. The diaphragm assembly disposed within the housing of the receiver is placed parallel to and in close proximity to the inner surface of the cover. The diaphragm assembly, attached to a thin film, is secured to the inner surface of the housing by any suitable method of attachment. The motion of the acoustic assembly, and hence its performance, is dependent on the materials used to make the diaphragm assembly and its resulting stiffness. Furthermore, the materials used to make the diaphragm assembly and thin film determine the thickness of the acoustic assembly.

There are a number of competing design factors. It is desirable to reduce the height of the receiver; however, the acoustic assembly may require a relatively thick diaphragm assembly to ensure adequate stiffness. The resulting receiver, one with a thin housing but thick diaphragm may be limited to very small diaphragm movement, limiting its suitability for certain applications.

BRIEF DESCRIPTION OF THE DRAWINGS

For a more complete understanding of the disclosure, reference should be made to the following detailed description and accompanying drawings wherein.

Figure 1:
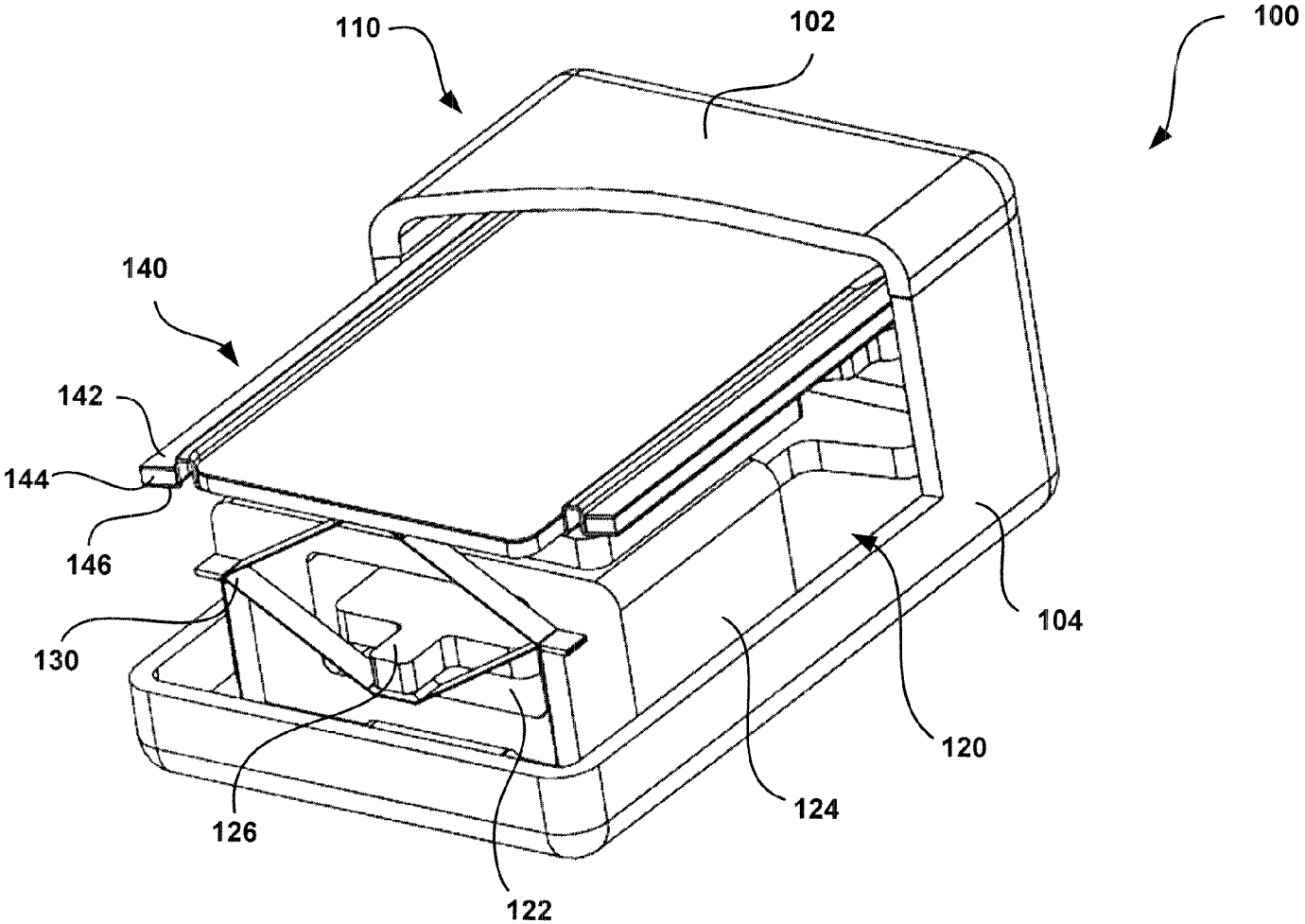
FIG. 1 is a is a perspective view of an acoustic assembly utilized in a transducer of one of the described embodiments.

The drawings are for illustrative purposes only and are not intended to be to scale.

DETAILED DESCRIPTION

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

FIG. 1 illustrates an exemplary embodiment of a transducer 100. The transducer 100 may be adapted as either a microphone, receiver speaker, accelerometer, Microelectromechanical System (MEMS) devices or other such device, and may be useful in such devices as listening devices, hearing aids, in-ear monitors, headphones, electronic hearing protection devices, very small scale acoustic speakers, and MEMS devices. The transducer 100 includes a motor assembly 120, a coupling assembly 130, and an acoustic assembly 140 disposed within a housing 110. The housing 110 may be rectangular and consists of a cover 102 and a base 104. In alternate embodiments, the housing 110 can be manufactured in a variety of configurations, such as a cylindrical shape, a D-shape, a trapezoid shape, a roughly square shape, a tubular shape, or any other desired geometry. In addition, the scale and size of the housing 110 may vary based on the intended application, operating conditions, required components, etc. Moreover, the housing 110 can be manufactured from a variety of materials, such as, for example, stainless steel, alternating layers of conductive materials, or alternating layers of non-conductive layers (e.g., metal particle-coated plastics). The base 104 may include a plurality of supporting members (not shown) adapted to support the motor assembly 120. In alternate embodiments, the base 104 may include an opening and a portion of the motor assembly 120 may then extend into the opening such that the motor assembly 120 and the base 104 are mutually interconnected.

The motor assembly 120 includes a drive magnet 122 and a magnetic yoke 124. The magnetic yoke 124 forms a frame having a central tunnel defining an enclosure into which the drive magnet 122 mounts. The magnetic yoke 124 may be made of a Nickel-Iron alloy, an Iron-Cobalt-Vanadium alloy or of any other similar materials. The drive magnet 122 may be made of a magnetic material such as Ferrite, AlNiCo, a Samarium-Cobalt alloy, a Neodymium-Iron-Boron alloy, or of any other similar materials. The motor assembly 120 may further include an armature 126 and a drive coil (not shown). In the embodiment shown in FIG. 1, the armature 126 is generally U-shaped. One of ordinary skill in the art will appreciate that the armature 126 may be E-shaped or of a different configuration such as disclosed in U.S. patent application Ser. Nos. 10/769,528 and 10/758,441, the discloses of which are incorporated herein by reference. A movable end of the armature 126 extends along the drive coil (not shown) and the magnetic yoke 124, which in turn connects to the acoustic assembly 140 via the coupling assembly 130 to drive the acoustic assembly 140. The coil (not shown) is located proximate to the drive magnet 122 and the magnetic yoke 124.

Adhesive bonding may secure the acoustic assembly 140 to the inner surface of the housing 110 and to the motor assembly 120 via the coupling assembly 130. Any other suitable attachment means may be used to couple the acoustic assembly to the motor assembly 120 via the coupling assembly 130. The arrangement of the acoustic assembly permits the transfer of electrical signal energy to vibrational energy in the acoustic assembly 140 or to transfer vibrational energy in the acoustic assembly 140 into electrical signal energy. In alternate embodiments, the acoustic assembly 140 is secured to the outer surface of the motor assembly 120 by bonding with adhesive or any other suitable method of attachment. The coupling assembly 130 may be a drive rod, a linkage assembly, a plurality of linkage assemblies, or the like. As depicted in FIG. 1, the coupling assembly 130 is a linkage assembly. The linkage assembly 130 typically fabricated from a flat stock material such as a thin strip of metal or foil may be formed into variety of shapes and configurations based on the intended application, operating conditions, required component, etc to amplify motion or force. Alternately, the linkage assembly 130 may be formed of plastic or some other compliant material.

The acoustic assembly 140 may be rectangular and consists of a first layer 142, a second layer 144, and a flexible layer 146. However, the acoustic assembly 140 may utilize multiple layers, and such embodiment will be discussed in greater detail. In alternate embodiments, the acoustic assembly 140 may be formed of various shapes and have a number of different of sizes in different embodiments based on the intended application. The first and second layers 142, 144 can be manufactured from a variety of materials such as aluminum, stainless steel, beryllium copper, titanium, tungsten, platinum, copper, brass, or alloys thereof, non-metals such as, plastic, plastic matrix, fiber reinforced plastic, etc., or multiples of these could be used. The first layer 142 is attached to the second layer 144 for example, by adhesive bonding, for example, ethylene vinyl acetate thermoplastic adhesive, thermo set adhesive, epoxy, polyimide, or the like. The flexible layer 146 attached to the composite layered structure may be made of Mylar, urethane, rubber or of any other similar materials.

Figure 2:
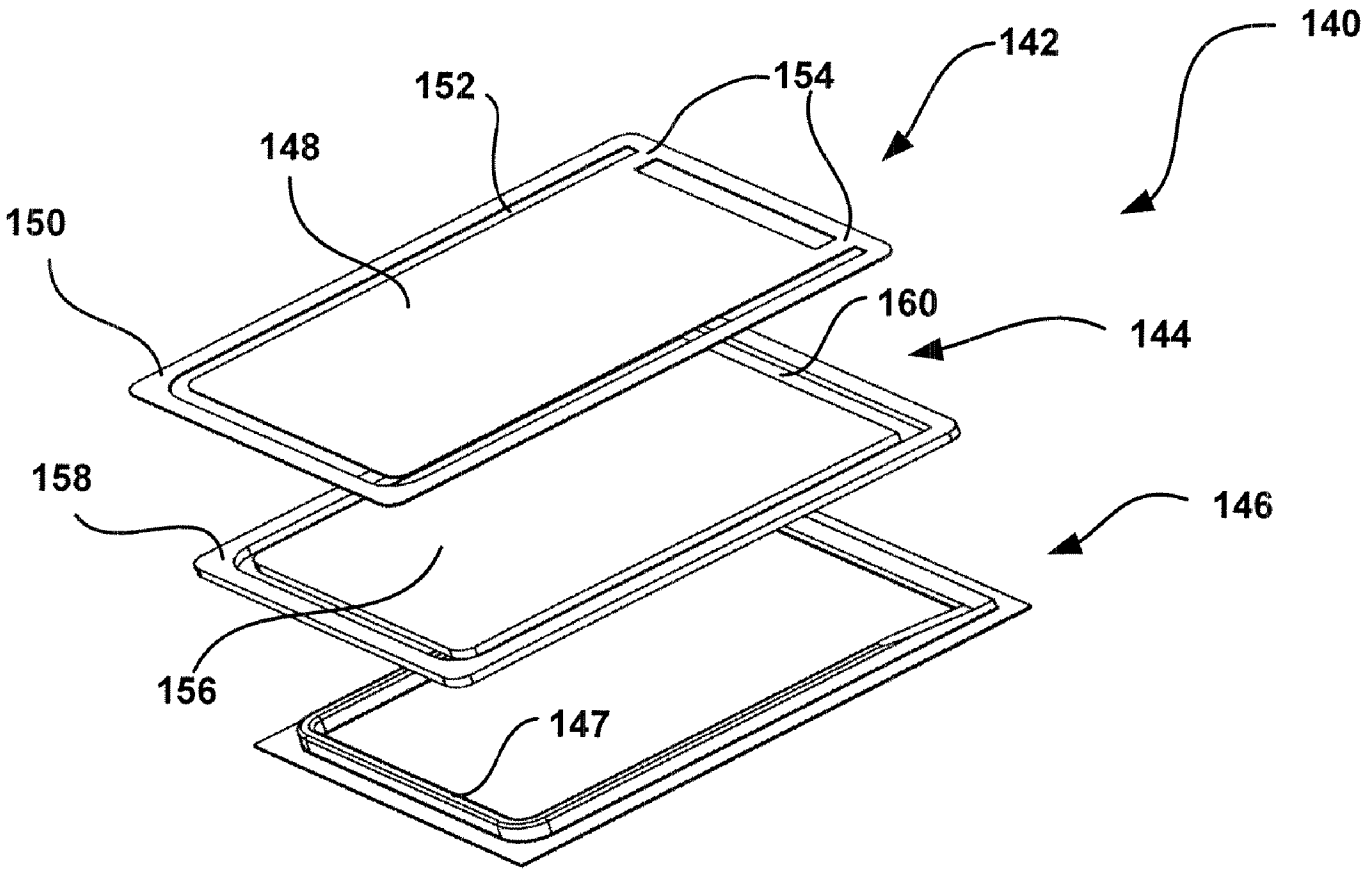
FIG. 2 is an exploded view of a described embodiment of an acoustic assembly.
Figure 3:
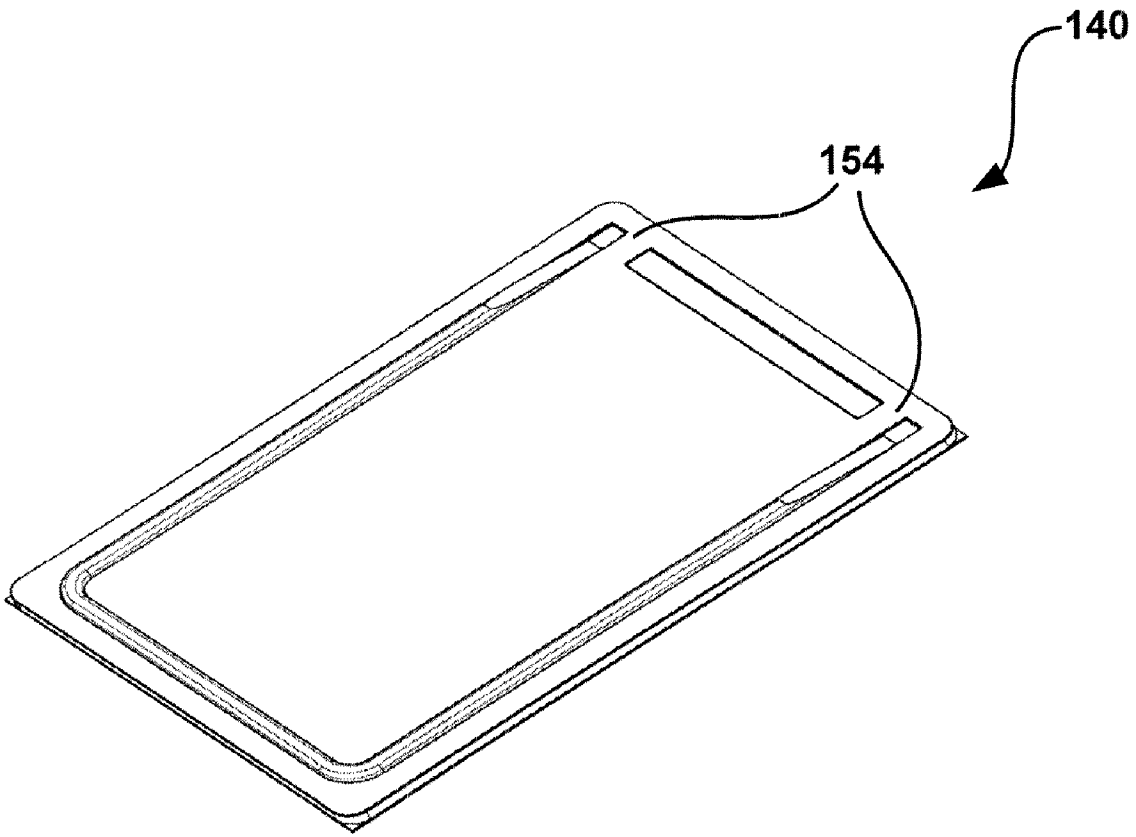
FIG. 3 is a perspective view of FIG. 2 of the described embodiment of the acoustic assembly.

FIGS. 2-3 illustrate an embodiment of the acoustic assembly 140 that can be used in a variety of transducers, including receivers similar to the receiver 100 illustrated in FIG. 1. The acoustic assembly 140 includes a first layer 142, a second layer 144, and a flexible layer 146. The first layer 142 and the second 144 are attached together, for example, by bonding with adhesive, welding compression, or mechanical attachment. The combined first and second layers 142, 144 may then be attached to the flexible layer 146 to constitute the acoustic assembly 140, which then may be operably attached to the linkage assembly 130 as shown in FIG. 1. In one example, the first layer 142 is made of stainless steel having a thickness of about 0.0005" to about 0.002". The first layer 142 includes a central portion 148, an edge portion 150, a hinge portion 154, and a passageway 152 formed between the central portion 148 and the edge portion 150. Two legs 153 connecting the central portion to the edge portion form a hinge 154. The legs may each have a width and length of approximately about 0.01". The hinge 154 allows the central portion of the acoustic assembly 140 to rotate easily around an intended axis while suppressing other forms of motion at the hinge such as shear motion or rotation along other axes. The second layer 144 includes a central portion 156, an edge portion 158, and a passageway 160 formed between the central portion 156 and the edge portion 158. The second layer 144 may optionally include a hinge (not shown) formed from legs.

In one example, the second layer 144 is made of stainless steel having a thickness of about 0.002" to about 0.015". Other materials having a density about 2 g/cm$^3$ to about 15 g/cm$^3$, or an elastic modulus of about 1.0E+10 Pascals (Pa) to about 2.5E+11 Pa may be employed separately of the first layer 142 to affect the resonant frequency of the overall acoustic assembly 140 or the moving mass of the acoustic assembly 140. It is to be understood that thickness, width, length, and materials other than those described above may be utilized as well. In this example, the overall thickness of the acoustic assembly 140 is less than the typical acoustic assembly, thereby taking up less space in the output chamber of the receiver 100. The flexible layer 146 may be made of Mylar, urethane, or of any other similar materials. As shown in FIG. 2, the flexible layer 146 is attached to the composite two layer structure. The flexible layer 146 includes a folded portion 147 that is disposed within the passageways 152, 160 between the edge portions 150, 158 and the central portions 148, 156 to form an airtight partition from a first side of the acoustic assembly to the second side of the acoustic assembly. The flexible layer 146 allows relatively unrestricted rotating movement of the central portions relative to the edge portions about the corresponding hinge portions.

In a lamination process, a temporary connecting material (not shown) may be disposed in the passageway 160 of the second layer 144 aligning and retaining the central portion 156 of the second layer 144 to the central portion 148 of the first layer 142. The central portion 156 of the second layer 144 is then attached to the central portion 148 of the first layer 142, for example, by bonding with adhesive, welding, compression, or mechanical attachment. The flexible layer 146 is attached to the second layer 144 and thus the second layer 144 to the first layer 142. Such fabrication process will be discussed in greater details. In alternate embodiments, a structural enhancing feature may be provided to the hinge. For example, hinge legs may be enlarged or provided with ribs or other structural enhancing structures. Alternatively, a large mass of adhesive may be applied to the hinge portion 154 to increase the rigidity around the hinge and enhance control of the movement of the acoustic assembly 140. The pivoting movement about the hinge provides control of the movement of the acoustic assembly 140 while delivering acoustic output sound pressure. It is to be understood that materials other than those described above may be utilized as well to control the rotational flexibility around the hinge.

Figure 4:
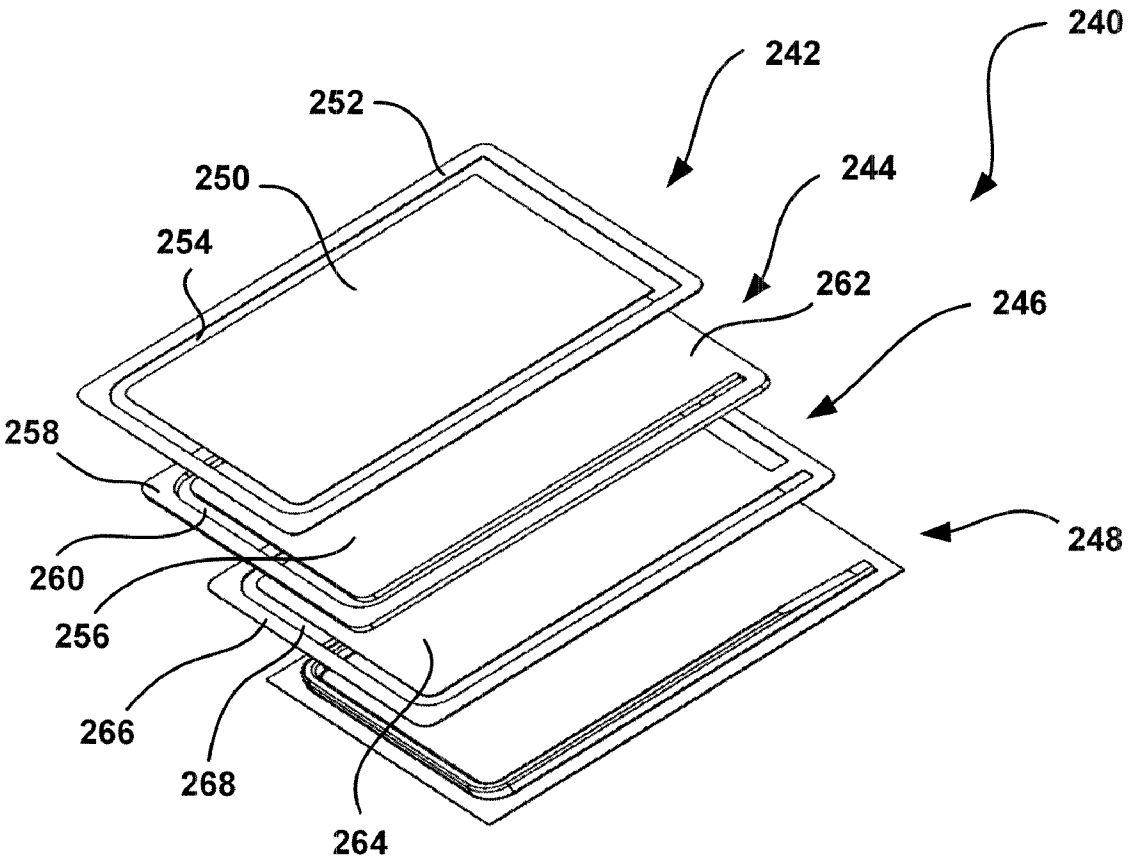
FIG. 4 is an exploded view of a second embodiment of an acoustic assembly.
Figure 5:
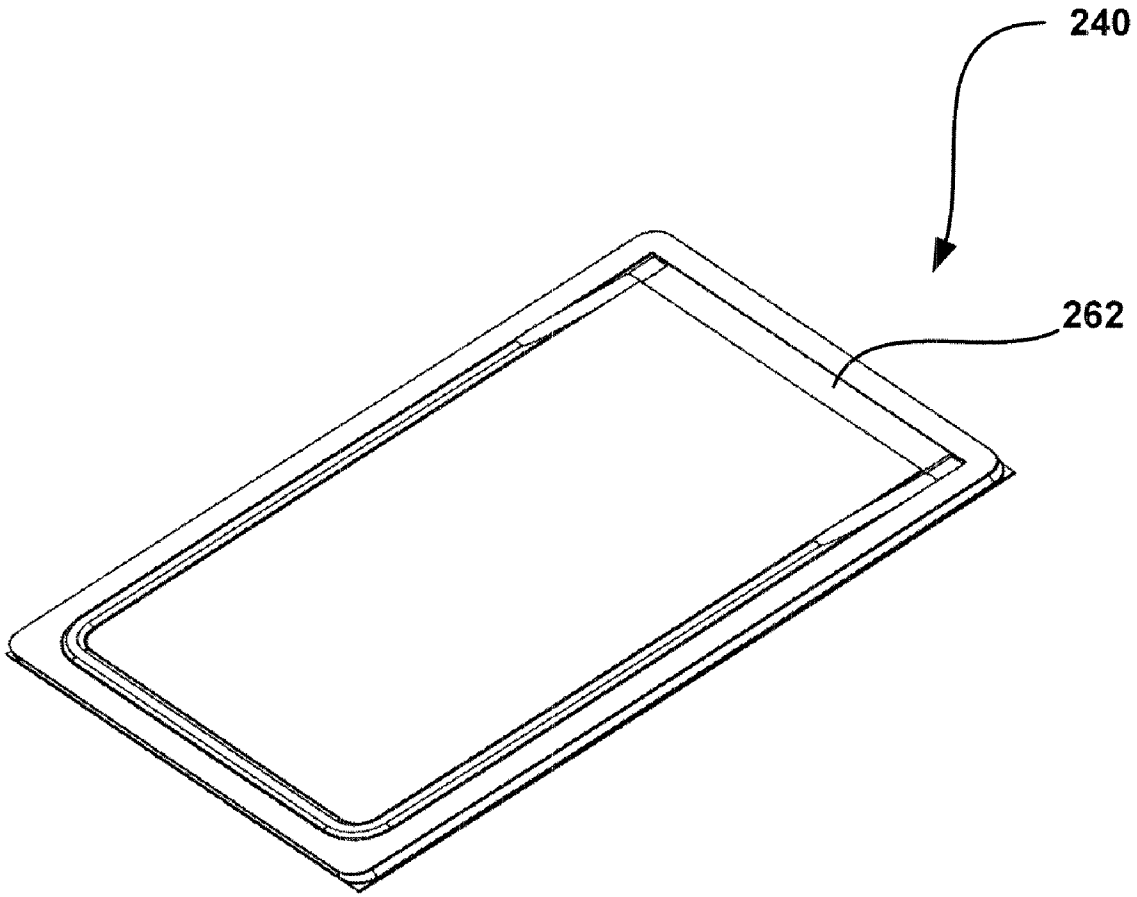
FIG. 5 is a perspective view of FIG. 4 of the second embodiment of the acoustic assembly.

FIGS. 4-5 illustrate another embodiment of an acoustic assembly 240. The acoustic assembly 240 includes a first layer 242, a second layer 244, a third layer 246, and a flexible layer 248. The second layer 244 is attached to the first layer 242 and the third layer 246 is attached to the second layer 244. The composite three layer structure may be a metal-polymer-metal construction, which forms the diaphragm. The flexible layer 248 attaches thereto to complete the acoustic assembly 240, which may then be operably attached to the linkage assembly 130 as is shown for the acoustic assembly 140 in FIG. 1.

The first, second and third layer 242, 244, 246 includes central portions 250, 256, 264, edge portions 252, 258, 266, and passageways 254, 260, 268, respectively. The passageways 254, 260, 268 are formed between the central portions 250, 256, 264 and edge portions 252, 258, 266. The second layer 244 further includes a hinge portion 262 which provides the same function as the hinge portion 154 as shown in FIG. 2-3, although it will be appreciated that the first and/or third layers may incorporate the hinge. In one example, the first and third layers 242, 246 can be formed from a material of high elastic modulus such as stainless steel, copper, brass, or alloys thereof, or beryllium copper (BeCu). The second layer 244 can be a dry adhesive sheet. For example, the second layer 244 may be formed from a material of low density such as modified ethylene vinyl acetate thermoplastic adhesive, a thermo set adhesive, an epoxy, or polyimide, that acts as an adhesive and spacer layer for joining and positioning the first and third layers of the structure while increasing the bending moment of the acoustic assembly 240 hence raising the resonant frequency of the central portion without adding significantly to the mass or thickness. In this example, the overall thickness of the acoustic assembly 240 is less than a typical acoustic assembly, thereby taking up less space in the output chamber of the receiver 100, which will be discussed in greater detail. As shown in FIG. 4, the flexible layer 248 may be made of Mylar, urethane, rubber or of any other similar materials, and includes a folded portion disposed within the passageways 254, 260, 268 to form an airtight partition while allowing unrestricted rotational movement between the edge portions 252, 258, 266 and the central portions 250, 256, 264 about the hinge portion 262. In this configuration, the composite three layer structure, such as the discussed metal-polymer-metal sandwich structure, enables control of resonant frequency of the central portion independent of the moving mass.

Typically, resonances of the central portion of the acoustic assembly 240 take the form of bending or twisting motions at certain frequencies, resulting in deviation of the moving mass of the central portion of assembly 240. To control the moving mass of the central portion of acoustic assembly 240 over a specified frequency range, it is generally desirable to control the lowest frequency of such resonant motion, in particularly, the bending motion of the central portion of assembly 240. The composite three layer structure enables control of the resonant frequencies independent of the moving mass. For given length and width dimensions of the central portion and for a hinged connection between the edge portion and the central portions of the composite three layer structure, the resonant frequencies are dependent on the ratio of mass per unit area to the stiffness of the central portion, which enables the paddle mass and paddle resonance characteristics to be independently pursued. The mass per unit area of the central portion is strongly influenced by the overall thickness and density of the metal layers since the metal layers have considerably higher densities than polymers. The stiffness of the central portion is influenced by both the thickness of the metal layers due to their high elastic modulus and the vertical separation between them as established by the polymer layer. A direct design approach is to allocate a total metal thickness, divide the thickness between the two metal layers that satisfies the paddle mass requirement and then set a polymer thickness which achieves sufficient plate stiffness in the overall acoustic assembly 240. The desired rotational and translational stiffness of the hinge further depends on having chosen a polymer material with the correct elastic modulus.

Figure 6:
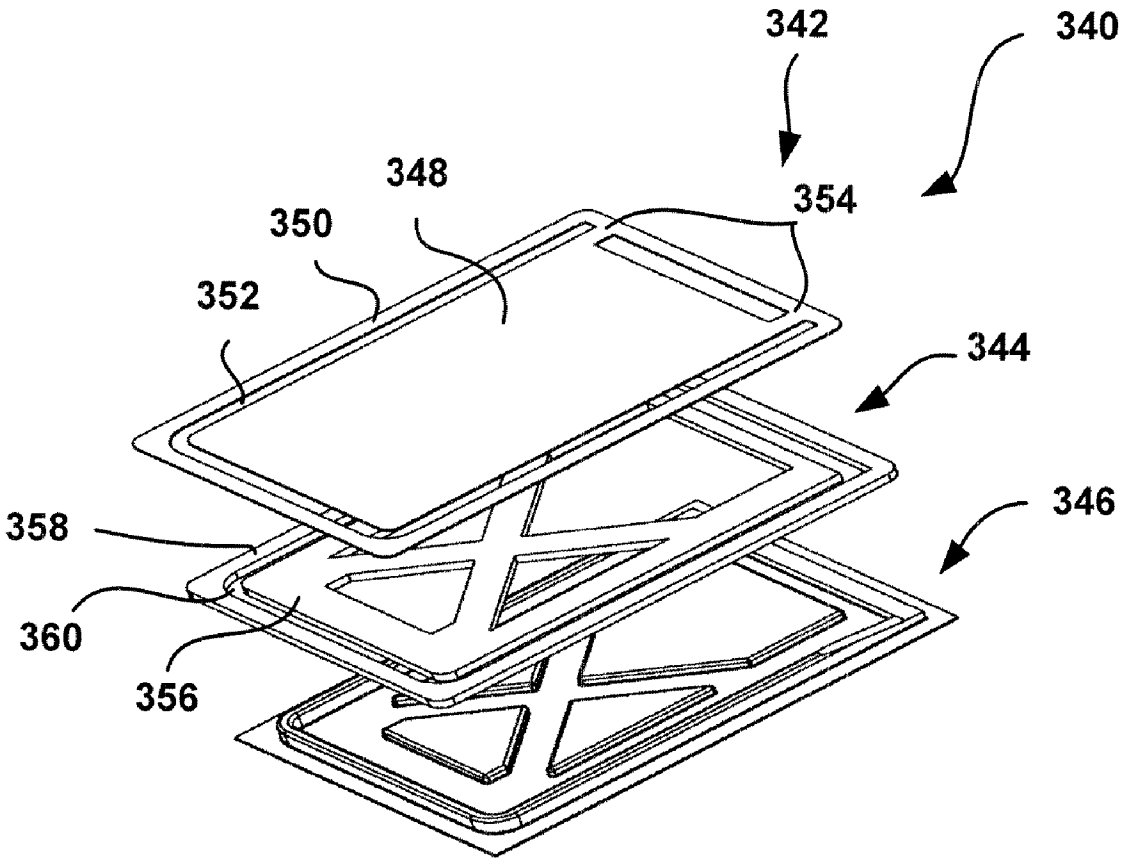
FIG. 6 is an exploded view of a third embodiment of an acoustic assembly.
Figure 7:
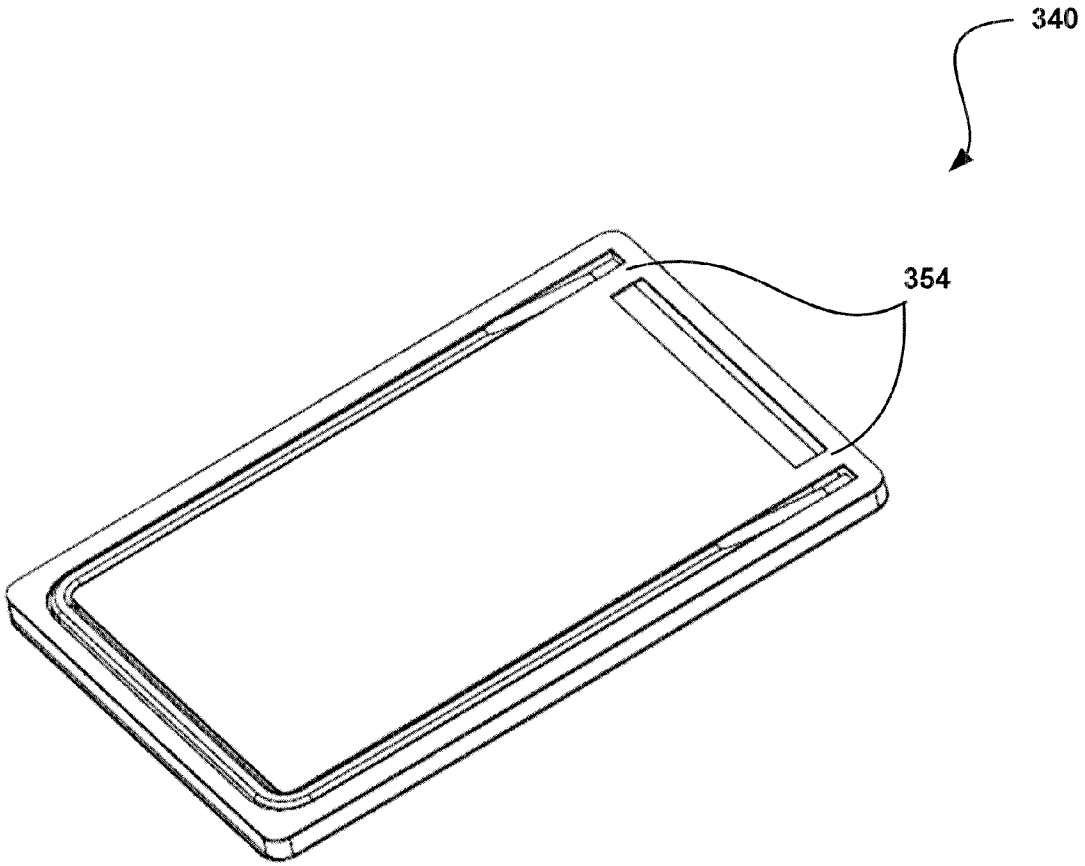
FIG. 7 is a perspective view of FIG. 6 of the third embodiment of an acoustic assembly.

FIGS. 6-7 illustrate yet another embodiment of an acoustic assembly 340. The assembly 340 is similar in construction and function as the assembly 140 illustrated in FIGS. 2-3, and similar elements are referred to using like reference wherein, for example 340 and 342 correspond to 140 and 142, respectively. In this embodiment, a central portion 356 of the second layer 344 is formed with pattern of apertures to facilitate control of the center of mass of the central portion 356. In alternate embodiments, the second layer 344 can be attached to the top surface of the first layer 342 and the flexible layer 346 is attached to the bottom surface of the first layer 342, which permits additional control of the resonant frequency of the acoustic assembly 340, thus requiring less space in the output chamber of the receiver 100, as depicted in FIG. 1. The pivoting movement about the hinge portion 354 also allows control of the movement of the acoustic assembly 340 while delivering maximum acoustic output sound pressure.

Figure 8:
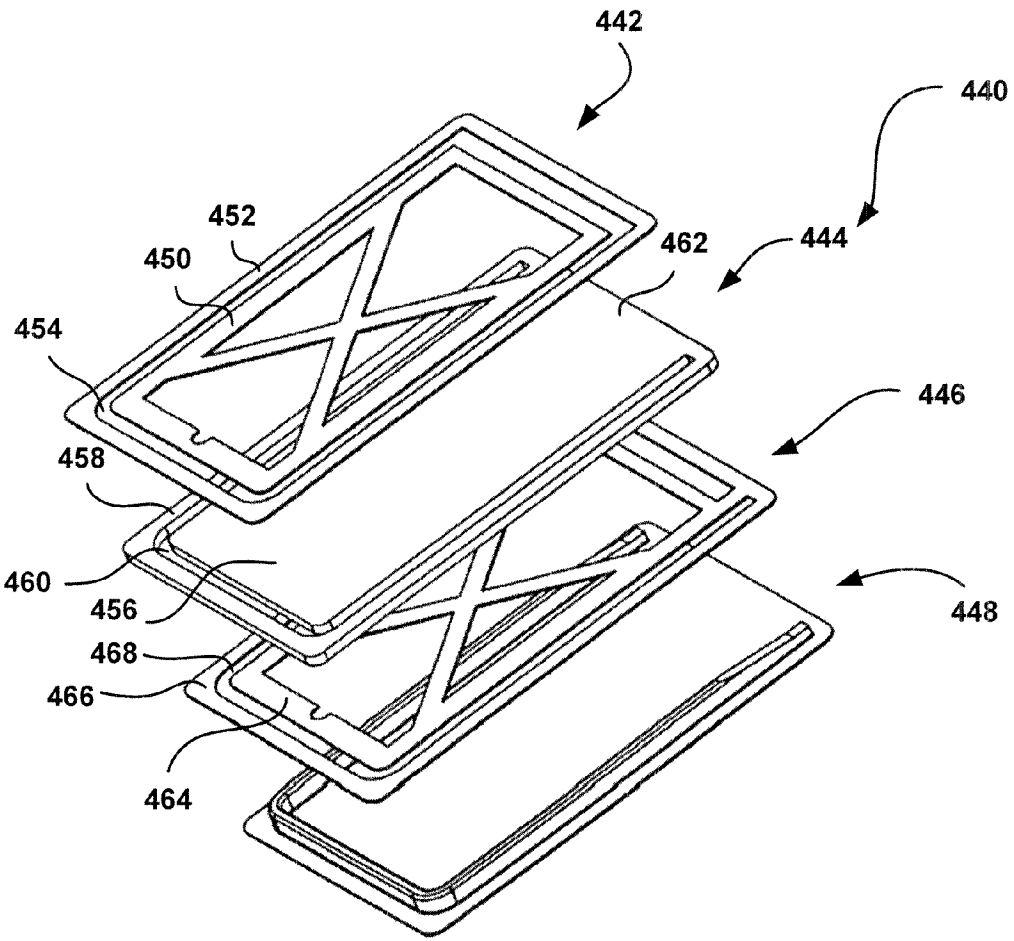
FIG. 8 is an exploded view of a fourth embodiment of an acoustic assembly.
Figure 9:
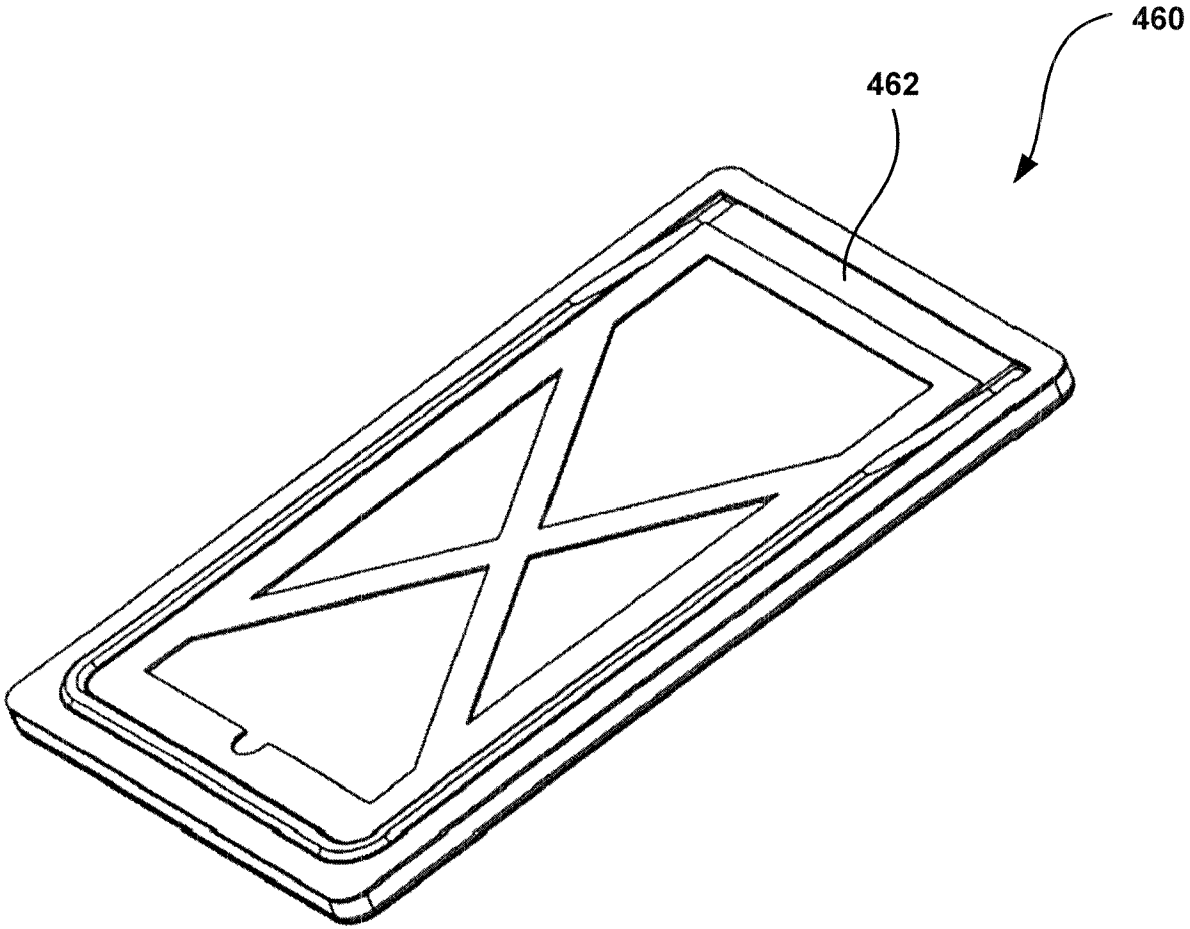
FIG. 9 is a perspective view of FIG. 8 of the fourth embodiment of an acoustic assembly.
Figure 10:
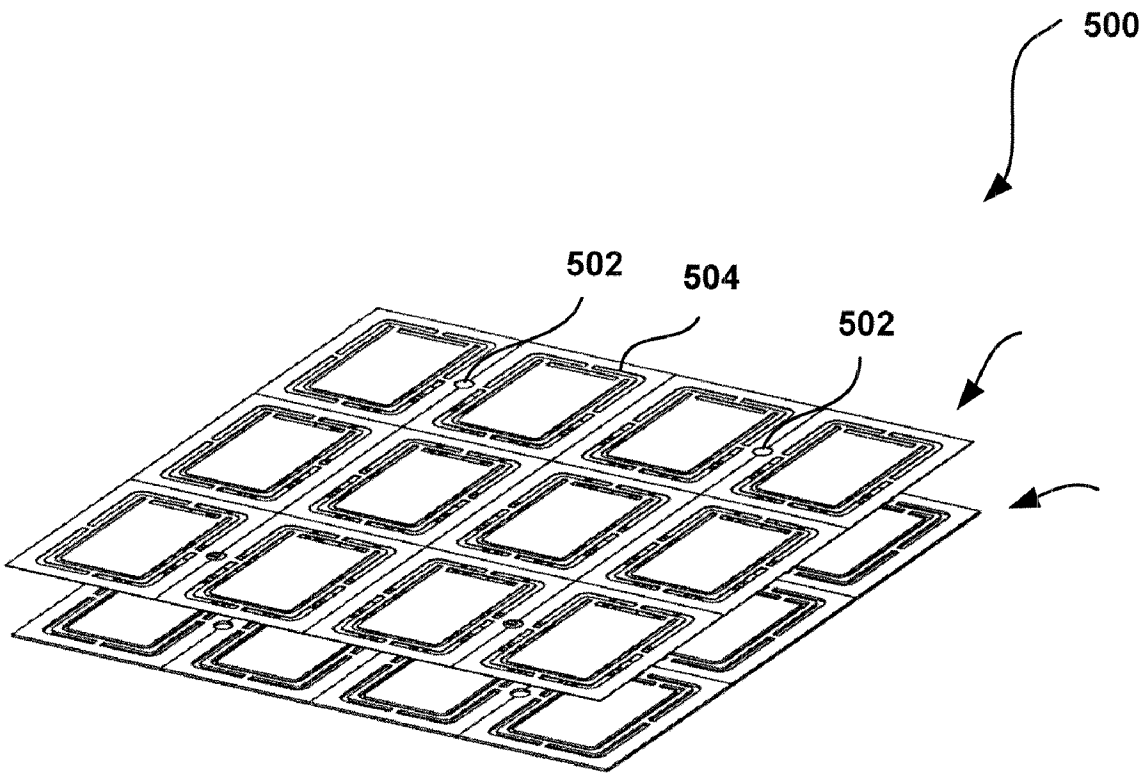
FIG. 10-13 represent layers carrying a plurality of formed acoustic assemblies.
Figure 11:
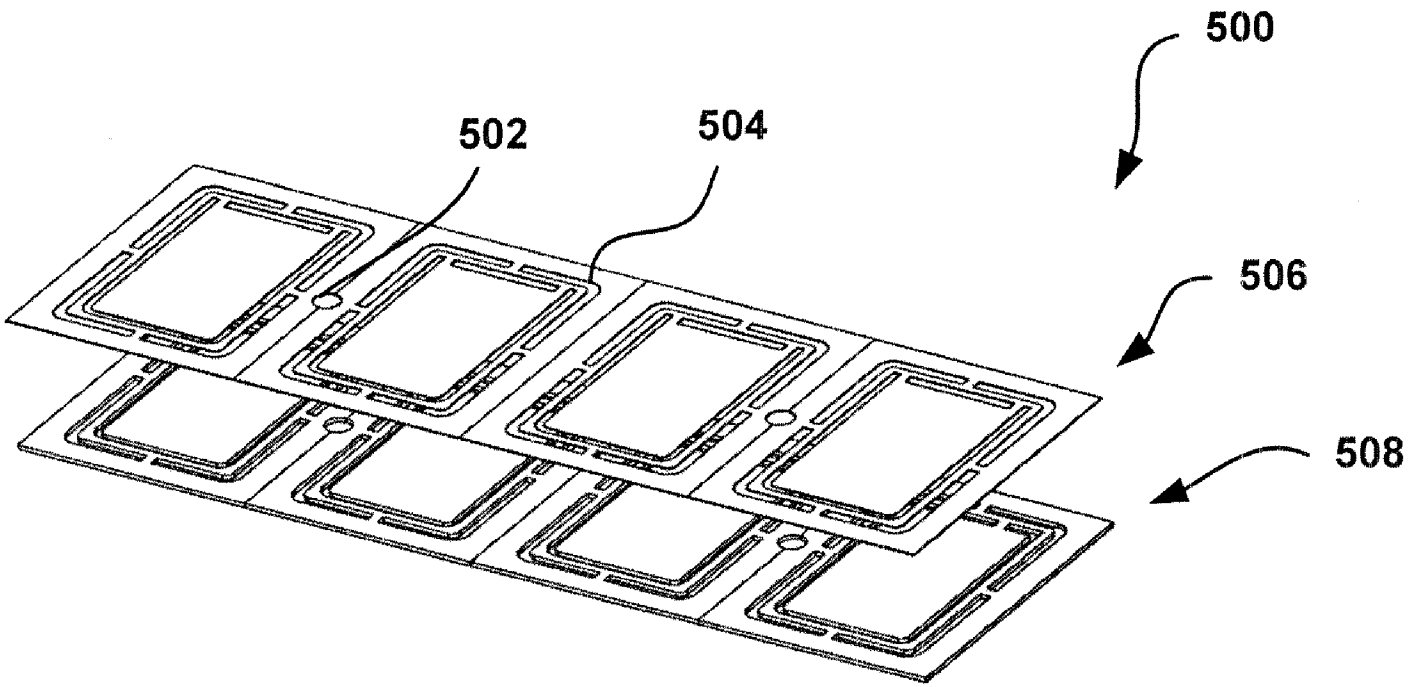
Figure 12:
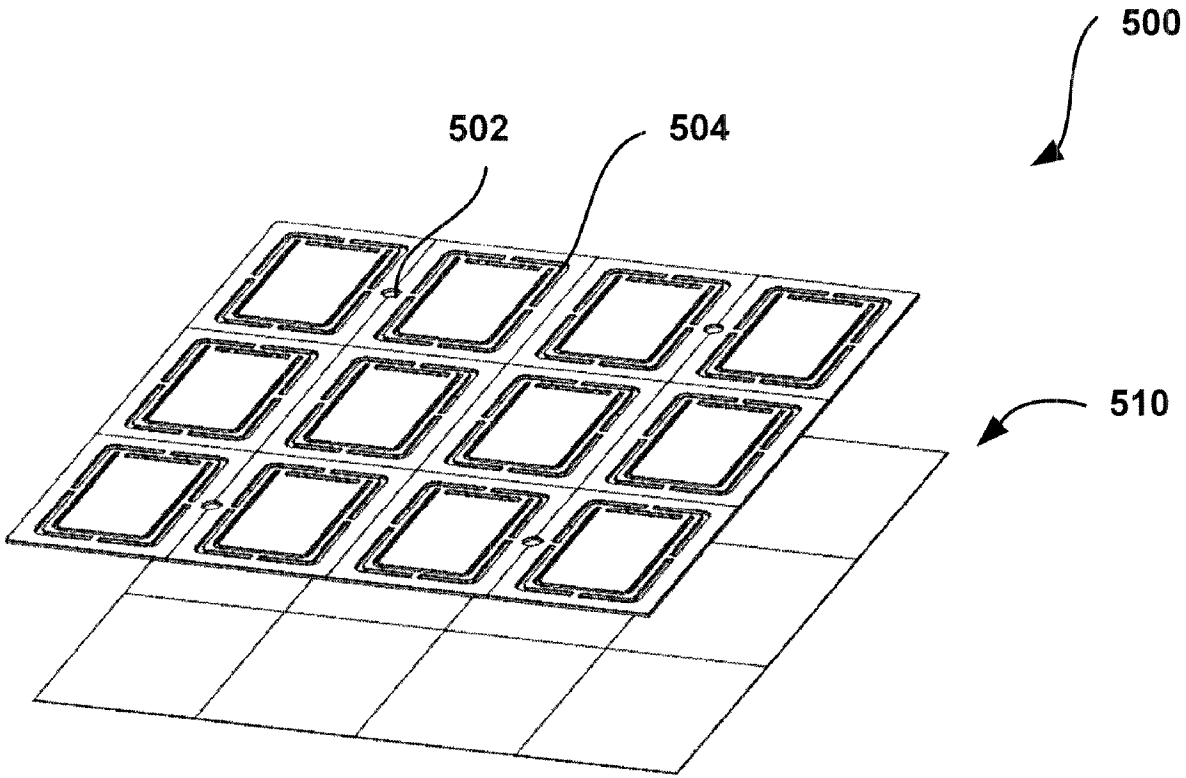
Figure 13:
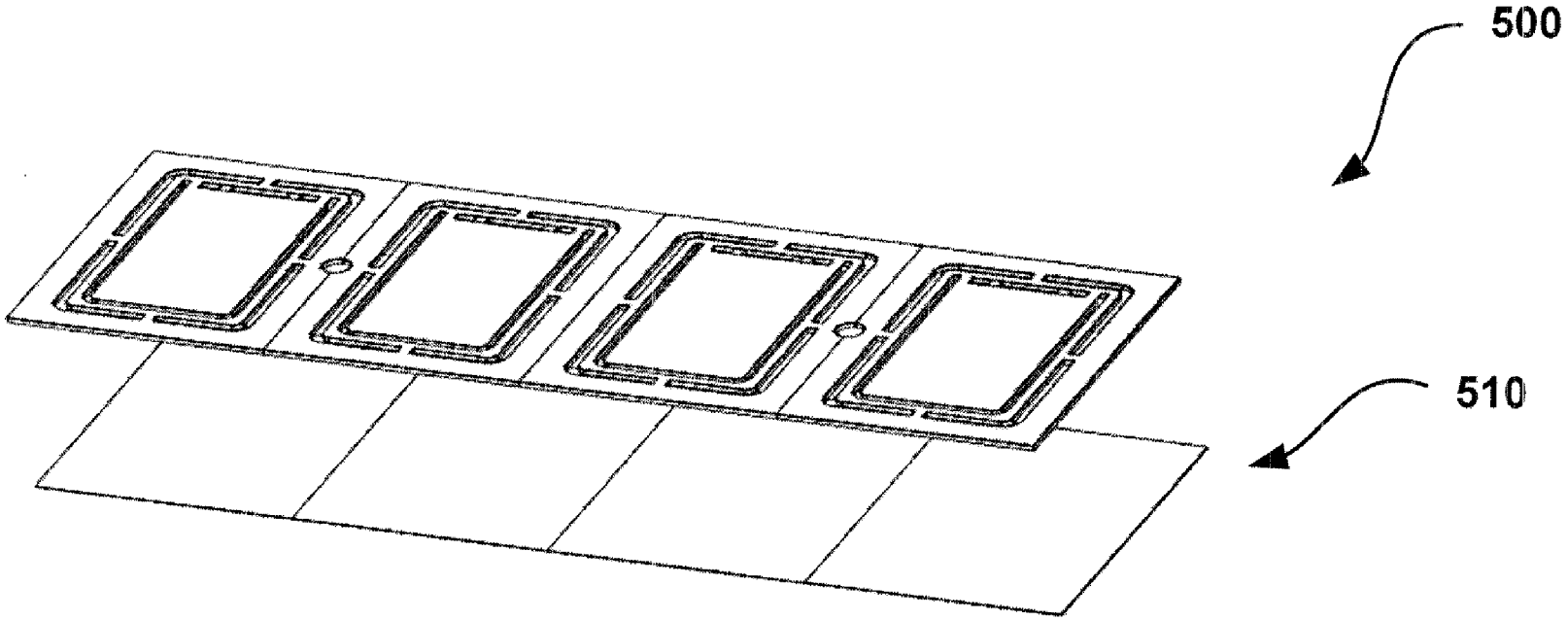
Figure 14:
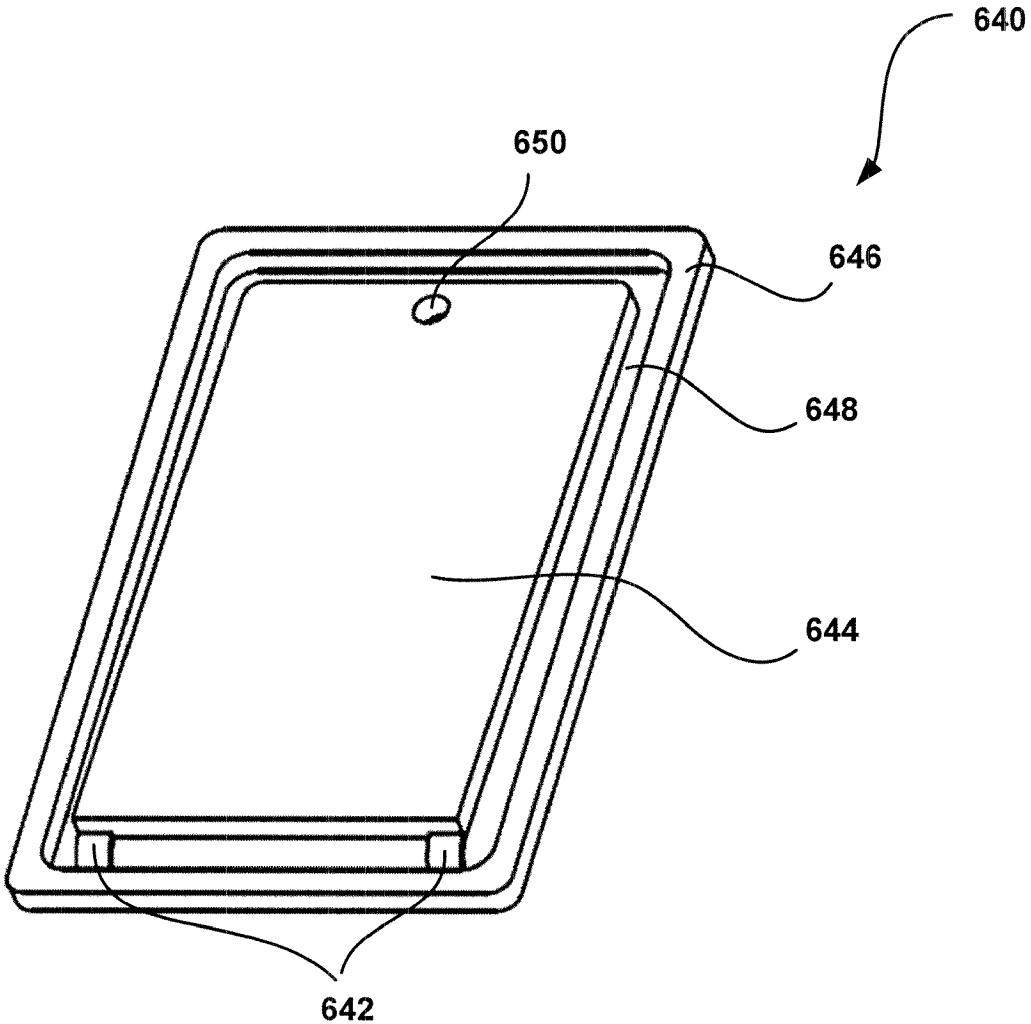
FIG. 14 is a perspective view of an acoustic assembly with a "S" hinge of one of the described embodiments.
Figure 15:
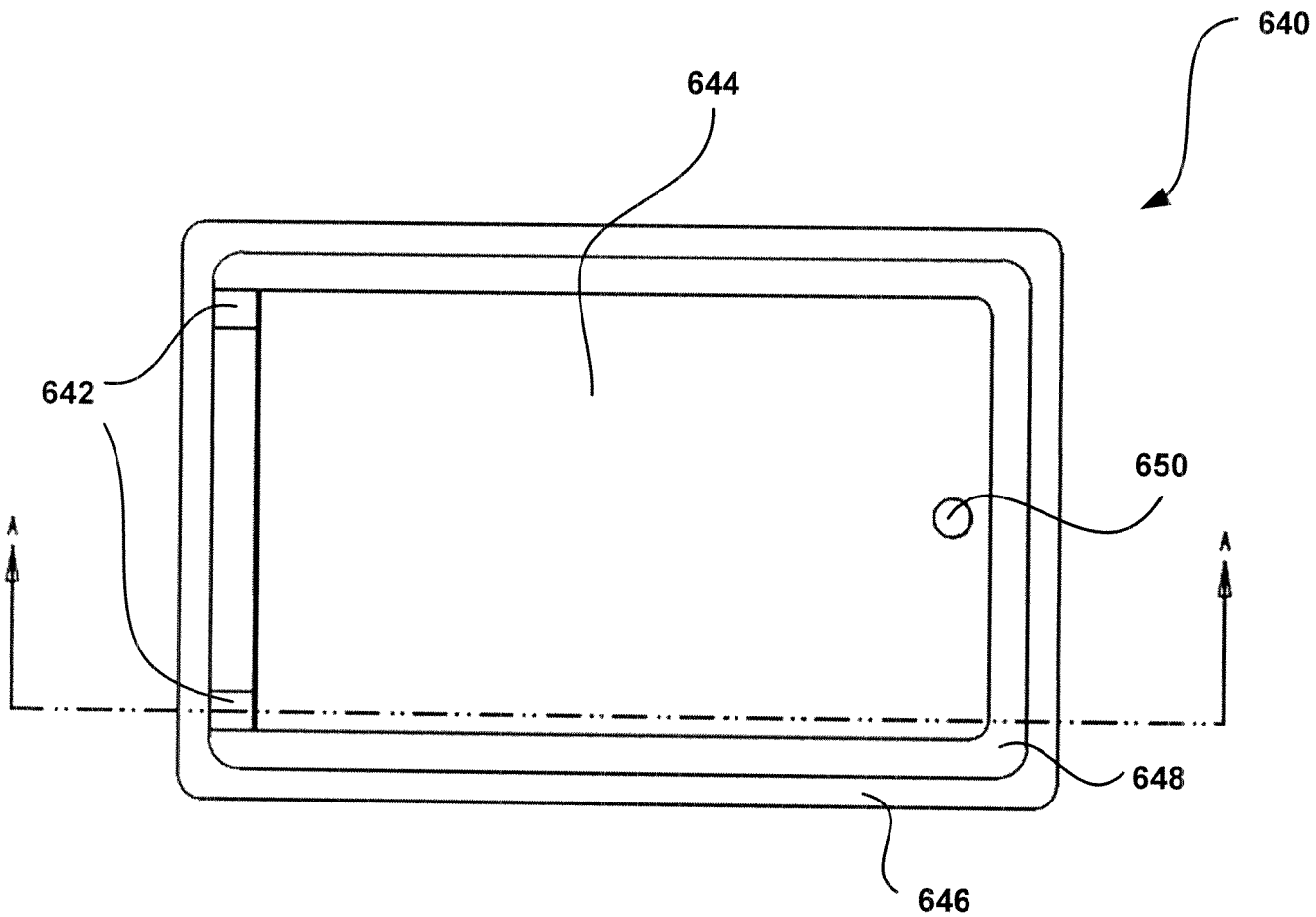
FIG. 15 is a top view of FIG. 14 of the described embodiment of the acoustic assembly.
Figure 16:
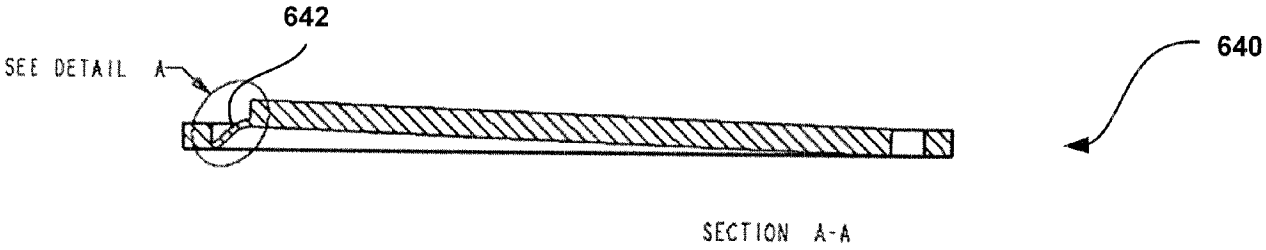
FIGS. 16-17 is a cross section view of a described embodiment of an acoustic assembly.
Figure 17:
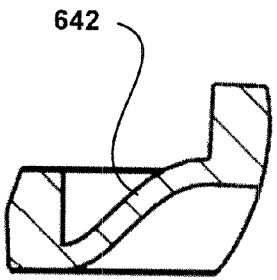

FIGS. 8-9 illustrate still another embodiment of an acoustic assembly 440. The acoustic assembly 440 is similar in construction and function to the acoustic assembly 240 illustrated in FIGS. 4-5, and similar elements are referred to using like reference numerals wherein, for example 440 and 442 correspond to 240 and 242, respectively. In this embodiment, central portions 450, 464 of the first and third layers 442, 446 in a pattern of apertures to facilitate controlling the center of mass of the acoustic assembly 440. A flexible layer 448 is attached to the composite, multi-layer structure. Also, the acoustic assembly 440 provides for controlling the resonant frequency in a thin design, thus requiring less space in the output chamber of the receiver 100, as depicted in FIG. 1. The pivoting movement about the hinge area 462 also allows control of the movement of the acoustic assembly 440, as well as stiffness of the moving mass of the acoustic assembly 440, while delivering acoustic output sound pressure.

FIGS. 10-13 are plan views illustrating a panel 500 for forming a plurality of acoustic assemblies. The acoustic assemblies are distributed on the panel 500 in an array. Fewer or more acoustic assemblies may be disposed on the panel 500, or on smaller or larger panels. As described herein, the acoustic assemblies include a number of layers, such as first layers, second layers, third layers, flexible layers, and the like. To assure alignment of the portions as they are brought together, each portion may be formed to include a plurality of alignment apertures 502 and inserts 504. To simultaneously manufacture several hundred or even several thousand acoustic assemblies, a first layer 506, such as described herein is provided. An adhesive layer, such as a sheet of dry adhesive is positioned under the first layer 506, and a second layer 508 is positioned under the first layer 506. The temporary legs located away from the hinge portion of the second layer 506 are then removed simultaneously in a second blanking operation. A flexible layer 510 is positioned under the second layer 508 and thus the second layer 508 to the first layer 506. The dry adhesive layer and the flexible layer are activated, such as by the application of heat and/or pressure. The panel 500 is then separated into individual acoustic assemblies using known panel cutting and separating techniques. In alternate embodiments, a three layer structure is laminated by any suitable method of attachment, e.g. adhesive. The three layer structure is typically patterned by lithography and/or laser milling having a central portion, an edge portion, a passageway, and hinge portion. In this embodiment, the hinge portion of middle layer of the three layer structure is formed a using photolithographic patterning process to create openings in the first and third layers, leaving an exposed portion of the middle layer. The flexible layer 510 positioned under the three layer structure is formed within the passageway to form an airtight partition while allowing unrestricted relative motion between the edge portion and the central portion. Yet in another embodiment, a forming sequence process using any type of circuit board fabrication to deposit, form, or otherwise create a layer of material. The acoustic assembly includes a first substrate, a second substrate, and a flexible layer. The first and second substrates may be made any material allowing processing in circuit board panel form and the flexible layer may be made of polyimide with a finishing layer of copper is applied on top surface of the flexible layer. The combined first and second layers are formed on the top surface of the flexible layer.

Figure 18:
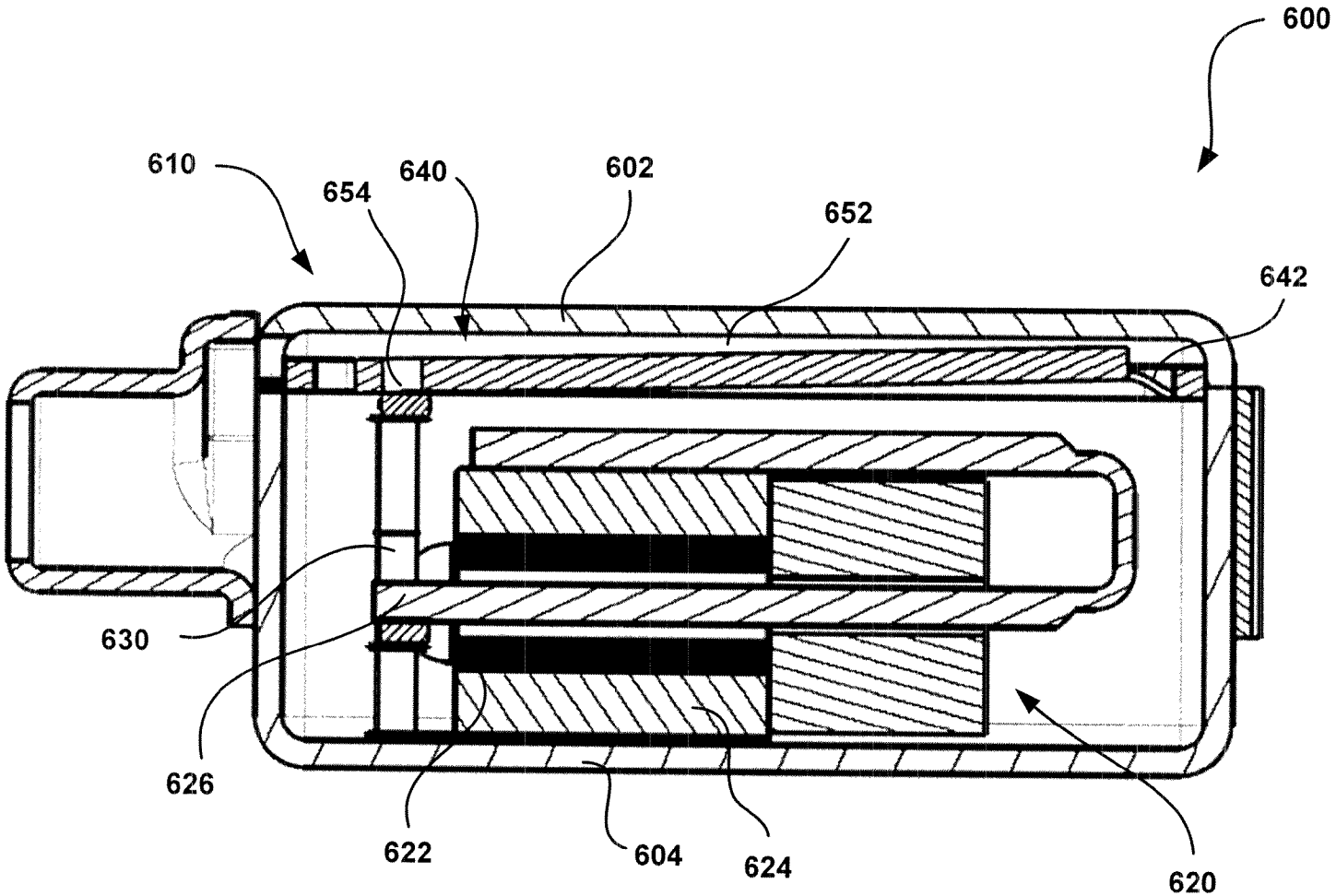
FIG. 18 is a cross section view of a described embodiment of an acoustic assembly.

FIGS. 14-18 illustrate an acoustic assembly 640 with a contoured hinge area. The acoustic assembly 640 is similar in construction and function as the assemblies illustrated in FIGS. 2-9. In this embodiment, a contour shape hinge 642 is formed at a position in the vicinity of the front end between the edge portion 646 and the central portion 644 of the acoustic assembly 640. The hinge 642 may be a thin strip of flexible metal such that the central portion 644 of the acoustic assembly 640 is non-parallel to the inner surface of the cover 602 while an aperture 650 is formed in the vicinity of the rear end of the acoustic assembly 640. The linkage assembly 630, as depicted in FIG. 18 corresponding to the aperture 650 in the acoustic assembly 640 is bonded to the aperture 650 by any suitable method of attachment, e.g. adhesive, to drive the acoustic assembly 640. In alternate embodiment, the aperture 650 is not required and the linkage assembly 130 is coupled to the inner surface of the acoustic assembly 640 as opposed to the hinge 642 by any suitable method of attachment. In this configuration, the front volume 652 between the acoustic assembly 640 and the inner surface of the cover 602 is reduced and the resonant frequencies of the receiver 600, which depend on the air volume contained in the front volume 652, are increased. Further, it may be possible to maximize the bandwidth as compared to a receiver utilizing an acoustic assembly parallel to and in close proximity to the inner surface of the cover 602. In alternate embodiment, the hinge 642 is formed at a position in the vicinity of the front end between the edge portion 646 and the central portion 644 of the acoustic assembly 640 such that the hinge 642 is in close proximity to the inner surface of the cover 602 and the central portion is non-parallel to the inner surface of the cover 602 of the receiver 600. Yet in alternate embodiment, the hinge 642 having a thickness is formed at a position in the vicinity of the front end and an unhinge end portion 654 depicted in FIG. 18 as opposed to the hinge 642 having a thickness less than the thickness of the hinge 642 is formed in the vicinity of the rear end of the acoustic assembly 640.

Still in alternate embodiment, the acoustic assembly 640 having a concavity is formed partially or wholly at the central portion 644. A preformed member may be made of conducting layers, non-conducting layers, layers of conducting/non-conducting, or any other similar materials is attached to the inner surface of the cover 602 to partially or wholly fill a portion of the concavity such that the central portion 644 of the acoustic assembly 640 is in close proximity to the inner surface of the cover 602, thus reduces the front volume. In a fifth aspect, the acoustic assembly 640 does not require a concavity. A fillable means is provided to partially or wholly fill the cover 602 with liquids, grease, gel, foam, latex, silicone, curable adhesive, plastic, metal, or any other similar materials. In a sixth aspect, a fillable means is provided to partially or wholly fill the space between the composite multilayer structure of the acoustic assembly with foam rubber, trapping air bubbles, or any other similar materials.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

The invention claimed is:

1. An acoustic assembly for use in a transducer, the acoustic assembly comprising:

a first layer member, the first layer member including a first center portion and a first edge portion, a first aperture formed in the first layer member separating the first center portion and the first edge portion, the first layer member having a first stiffness;

a second layer member, the second layer member including a second center portion and a second edge portion, a second aperture formed in the second layer member separating the second center portion and the second edge portion such that the second center portion is free to move relative to the second edge portion, the second layer member having a second stiffness;

an assembly including the first layer member and the second layer member, wherein the first center portion and the second center portion are coupled; the first edge portion and the second edge portion are coupled, and the first aperture and the second aperture are substantially aligned to define a passage way between the assembled first and second center portions and the assembled first and second edge portions, the assembly having an assembly stiffness, the assembly stiffness being greater than either the first stiffness or the second stiffness;

an integral hinge disposed in at least one of the first layer member or the second layer member, the hinge joining the assembled first and second center portions and the first and second edge portions such that the assembled first and second center portions is free to at least partially rotate relative to the assembled first and second edge portions about an axis, and a flexible layer member coupled to the assembly, the flexible layer member having a stiffness substantially less than the first stiffness, the second stiffness and the assembly stiffness, the flexible member substantially airtight sealing the passageway between a first side of the assembly and a second side of the assembly while sustaining an ability of the assembled first and second center portions to rotate relative to the first and second edge portions.

2. The acoustic assembly of claim 1, wherein each of the first layer member and the second layer member are formed of a material having an elastic modulus in the range of about 1.0E+10 Pascals (Pa) to about 2.5E+11 Pa.

3. The acoustic assembly of claim 1, wherein the first layer member is formed of a material selected from the group of materials consisting of: aluminum, stainless steel, beryllium, copper, titanium, tungsten, platinum, copper, brass and alloys thereof.

4. The acoustic assembly of claim 1, wherein the second layer member is formed of a material selected from the group of materials consisting of: aluminum, stainless steel, beryllium, copper, titanium, tungsten, platinum, copper, brass and alloys thereof.

5. The acoustic assembly of claim 1, wherein the first layer member is formed of a material selected from the group of materials consisting of: plastic, plastic composites, fiber reinforced plastic and combinations thereof.

6. The acoustic assembly of claim 1, wherein the second layer member is formed of a material selected from the group of materials consisting of: plastic, plastic composites, fiber reinforced plastic and combinations thereof.

7. The acoustic assembly of claim 1, wherein the flexible layer member is formed of a material selected from the group of materials consisting of: mylar, urethane, rubber and combinations thereof.

8. The acoustic assembly of claim 1, the hinge coupling at least one of the first center portion and the second center portion to at least one of the first edge portion and the second edge portion, respectively.

9. The acoustic assembly of claim 8, the hinge comprising at least one leg formed between at least one of the first center portion and the second center portion and the first edge portion and the second edge portion, respectively.

10. The acoustic assembly of claim 1, the hinge comprising a structure enhancing feature.

11. The acoustic assembly of claim 10, the structure enhancing feature comprising adhesive applied to the hinge.

12. The acoustic assembly of claim 1, the hinge comprising a contoured structure.

13. The acoustic assembly of claim 12, the contoured structure having an "s" shape.

14. The acoustic assembly of claim 12, the contoured structure aligning the assembled first and second center portions in a non-parallel orientation with respect to the assembled first and second edge portions.

15. The acoustic assembly of claim 1, comprising a third layer member, the third layer member including a third center portion and a third edge portion, a third aperture formed in the third layer member separating the third center portion and the third edge portion, the third layer member having a third stiffness; and the assembly further including the third layer member.

16. The acoustic assembly of claim 1, the third layer member being disposed between the first layer member and the second layer member in the assembly.

17. The acoustic assembly of claim 16, the third layer member being formed of a material selected from the group of materials consisting of: thermoplastic adhesive, thermoset adhesive, epoxy, polyimide and combinations thereof.

18. The acoustic assembly of claim 16, the third layer member being a dry adhesive layer.

19. The acoustic assembly of claim 1, the assembled first and second center portions being coupled by adhesive bonding, welding, compression, mechanical fastener and combinations thereof.

20. The acoustic assembly of claim 1, the assembled first and second edge portions being coupled by adhesive bonding, welding, compression, mechanical fastener and combinations thereof.

21. The acoustic assembly of claim 1, the flexible layer member comprising a fold portion, the fold portion being disposed within the passageway.

22. The acoustic assembly of claim 1, at least one of the first center portion and the second center portion being formed with apertures.

23. The acoustic assembly of claim 22, the flexible layer member airtight sealing the apertures.

24. A transducer comprising an acoustic assembly in accordance with claim 1.

25. A receiver comprising an acoustic assembly in accordance with claim 1.

26. A listening device comprising an acoustic assembly in accordance with claim 1.

27. A receiver comprising a housing having sound port and disposed within the housing a motor assembly, a coupling assembly and a composite, multilayer acoustic assembly including at least two layers, the at least two layers being pivotally coupled together by a hinge that is integral to at least one of the two layers, the acoustic assembly being coupled by the coupling assembly to the motor assembly and the acoustic assembly being in communication with the sound port.

* * * * *

UNITED STATES PATENT AND TRADEMARK OFFICE

CERTIFICATE OF CORRECTION

PATENT NO. : 7,860,264 B2
APPLICATION NO. : 11/277695
DATED : December 28, 2010
INVENTOR(S) : Mekell Jiles et al.

It is certified that error appears in the above-identified patent and that said Letters Patent is hereby corrected as shown below:

IN THE CLAIMS:

Claim 3, Column 9, Line 32, delete “copper,” (second occurrence).

Claim 4, Column 9, Line 37, delete “copper,” (second occurrence).

Signed and Sealed this
Eighth Day of November, 2011

David J. Kappos

David J. Kappos
*Director of the United States Patent and Trademark Office*